US009943175B1

(12) United States Patent
Spencer

(10) Patent No.: US 9,943,175 B1
(45) Date of Patent: Apr. 17, 2018

(54) INFANT SUPPORT DEVICE

(71) Applicant: James W. Spencer, Belleair, FL (US)

(72) Inventor: James W. Spencer, Belleair, FL (US)

(73) Assignee: Crescent Womb, LLC, Clearwater, FL (US)

( * ) Notice: Subject to any disclaimer, the term of this patent is extended or adjusted under 35 U.S.C. 154(b) by 76 days.

(21) Appl. No.: 15/040,630

(22) Filed: Feb. 10, 2016

(51) Int. Cl.
*B68G 5/00* (2006.01)
*A47C 16/00* (2006.01)
*A47D 9/00* (2006.01)

(52) U.S. Cl.
CPC ..... *A47D 9/00* (2013.01)

(58) Field of Classification Search
CPC ..... A47C 17/00; A47C 17/84; A47C 3/021; A47C 3/0255; A45F 3/22; A45F 3/00; A47D 7/04
See application file for complete search history.

(56) References Cited

U.S. PATENT DOCUMENTS 485,081 A * 10/1892 Baird ..... A47D 13/06 256/25
2,222,070 A * 11/1940 Graves ..... A47K 3/001 248/163.2
4,664,266 A * 5/1987 Fausett ..... A47B 96/022 211/87.01
4,941,453 A * 7/1990 Shakas ..... A47D 9/02 5/98.3
5,095,563 A 3/1992 Miller
5,274,863 A * 1/1994 Fountain ..... A47D 9/00 5/120
5,406,655 A * 4/1995 Sahlin ..... A47K 3/064 4/572.1
5,664,273 A * 9/1997 Obriot ..... A47D 15/001 5/724
5,699,571 A * 12/1997 Yowell ..... A47C 21/046 5/652.1
5,855,031 A * 1/1999 Swift, Jr. ..... A47D 7/04 5/655

(Continued)

OTHER PUBLICATIONS

Rosas, Kim. Baby Hammock Comparison: Which to choose? Dirty Diaper Laundry website. http://dirtydiaperlaundry.com/baby-hammock-comparison-which-to-choose/, accessed on May 3, 2016.

(Continued)

*Primary Examiner* — David E Sosnowski
(74) *Attorney, Agent, or Firm* — Andriy Lytvyn; Smith & Hopen, P.A.

(57) ABSTRACT

An infant support device for holding an infant. A fabric panel is taut between two or more anchor points. The anchor points may be disposed on a support frame or another structure capable of supporting the fabric panel and a weight of an infant. The fabric panel contains an aperture. A mesh insert is affixed to the fabric panel at the contour of the aperture. The mesh insert has a lower stiffness than the fabric panel. The mesh insert contains a plurality of holes sized to permit air to flow therethrough while preventing an infant's limbs and appendages from entering therein. Responsive to an infant being placed onto the mesh insert, the mesh insert elastically deforms thereby transitioning into a stretched configuration, in which the mesh insert urges the infant's spine into a convex curve.

20 Claims, 4 Drawing Sheets

(56) References Cited

U.S. PATENT DOCUMENTS

| | | | | |
|---|---|---|---|---|
| 5,978,989 | A * | 11/1999 | Chavez | A61G 1/01 294/140 |
| 6,112,343 | A * | 9/2000 | Dixon | A47K 3/024 4/571.1 |
| 6,276,383 | B1 * | 8/2001 | Galstad | E04H 15/58 135/115 |
| 8,117,691 | B2 * | 2/2012 | Bishop | A45F 3/22 296/190.02 |
| 8,613,118 | B1 | 12/2013 | Boos | |
| 8,745,793 | B2 * | 6/2014 | Bensoussan | A47D 13/08 5/652.1 |
| 8,919,284 | B2 * | 12/2014 | Wolfe, Jr. | A01K 15/02 119/28.5 |

OTHER PUBLICATIONS

Oxford Dictionary, Definition of the word "seam," http://www.oxforddictionaries.com/us/definition/american_english/seam, accessed on Sep. 1, 2016.

Kickstarter Project Page, Crescent Womb: Infant Safety Bed by James Spencer, https://www.kickstarter.com/projects/1727087541/crescent-womb-infant-safety-bed , accessed on Sep. 1, 2016.

Pike, J. et al. Bassinet Use and Sudden Unexpected Death in Infancy, The Journal of Pediatrics, vol. 153, Issue 4 pp. 509-512, Oct. 2008.

* cited by examiner

INFANT SUPPORT DEVICE

BACKGROUND OF THE INVENTION

1. Field of the Invention

This invention relates to infant support devices. More specifically, it relates to an infant support device having a fabric panel with a mesh insert configured to urge an infant's spine into a convex curve.

2. Brief Description of the Related Art

Research shows that it is highly beneficial for human infants to sleep in a "fetal position" in which the spine retains a convex curve. This position promotes development of muscle tissue, facilitates proper breathing, improves digestion, helps maintain a proper body temperature, and soothes the infant. Despite these well-known benefits, most conventional cradles and bassinets have flat mattresses that retain an infant's spine in a straight position against its natural curve. Maintaining an infant's spine in a straight position may cause discomfort, inhibit proper muscle development, and, in some cases, may even cause physical deformities, such as plagiocephaly.

A number of hammock-like infant support devices designed to retain an infant in a fetal position are known in the art. They all, however, have major drawbacks that have hindered their widespread adoption. For example, the infant support devices of the type disclosed in U.S. Pat. No. 5,095,563 use a net as a support surface. Placing an infant onto a net can be quite dangerous. The strands of the net provide uneven support to the infant and may create pressure points which can lead to bruising and rashes. Furthermore, there is a concern that an infant's limb or an appendage may get stuck in the opening between the strands, which may lead to an injury. Yet another disadvantage of such devices is that there is a possibility that an infant may roll out of the net by simply shifting the center of its gravity. Finally, the '563 patent discloses that the support surface is attached to the support frame only at two anchor points making the hammock-like structure prone to turning over, which cause the infant to fall out.

Another type of hammock-like infant support devices is disclosed in U.S. Pat. No. 8,613,118. In this type, a sheet of fabric is loosely hung between two anchor points. A major drawback of using a sheet of fabric as a support surface is that the stiffness of the fabric hinders it from enabling the infant's spine to achieve its full natural convex curve. A compromise must be made between selecting a fabric that has sufficient stiffness to provide adequate support to the infant's body or a fabric that is flexible enough to deform into a shape that urges infant's spine into a convex curve. These two characteristics are generally mutually exclusive. Consequently, because the fabric must be stiff enough to support the weight of the infant, the infant support devices of this type do not permit the infant's back to achieve the full extent of its normal convex curve. Another concern with the fabric-type hammock devices is that if infant falls asleep in a position in which its nasal and mouth openings become obstructed by the fabric, the flow of oxygen to the infant's lungs may become constricted, which may cause affixation.

Accordingly, there is a need for a hammock-like infant support device that has sufficient stiffness to properly support the weight of an infant, yet is flexible enough to enable the infant's spine to achieve its full natural convex curve. Furthermore, there is a need for an infant support device having a support material that does not restrict the flow of air therethrough, but does not permit the infant to entangle its limbs and appendages into the openings through which the air flows. Finally, there is a need for an infant support device that is portable and can be used in a variety of settings and applications while providing adequate stability.

SUMMARY OF THE INVENTION

The long-standing but heretofore unfulfilled need for a safe, portable, and simple-to-use infant support device that can securely support the weight of an infant while exhibiting sufficient flexibility to urge an infant's spine into a natural convex curve.

An infant support device includes a panel configured to be disposed between two or more anchor points. In some embodiments, it may be advantageous for the panel to be disposed between four anchor points to increase stability. An aperture is disposed within the panel. The aperture has a contour that defines an inner perimeter of the panel. The dimensions of the aperture must be sufficient to permit a human infant to pass therethrough: in one embodiment, the length of the aperture is between eighteen to forty-eight inches designed to accommodate human infants ages zero to eighteen months.

An insert is affixed to the panel at the inner perimeter thereof. The insert occludes the aperture. The insert has lower stiffness than the panel, which allows the insert to stretch out below the surface of the panel to accommodate a natural convex curve of the infant's spine, while the more rigid panel provides adequate support and stability for the insert with the infant positioned thereon. The insert has a first non-stretched configuration and a second stretched configuration when an infant is placed onto the insert.

A plurality of holes is disposed within the insert. The holes are sized to permit air to pass therethrough while preventing an infant's limb or appendage from entering therein. In an embodiment, each hole has a width ranging from one millimeter to ten millimeters when measured while the insert is in the stretched configuration. Responsive to an infant being placed onto the insert, the insert undergoes an elastic deformation thereby transitioning from the first non-stretched configuration into the second stretched configuration in which the insert urges a spine of the infant into a convex curve. The panel, which is more rigid than the insert, provides sufficient support for the stretched insert with the infant placed therein. The contour of the aperture within the panel defines the periphery of the insert, which serves as a barrier preventing the infant from rolling out of the support device: because the infant is positioned below the edge of the aperture, the infant cannot roll out or climb out of the insert.

In an embodiment, the infant support device may further include a support frame, which provides anchor points to which the panel is secured. The support frame may be constructed from a plurality of support frame members, wherein the support frame members can be connected to one another, thus forming the support frame. The support frame members can disconnected to reduce an amount of space needed for storage and transportation of the support frame.

In an embodiment, the insert is made out of nylon, spandex, or both. In an embodiment, the insert is 95% nylon and 5% spandex.

In an embodiment, the aperture within the panel has a length of between eighteen to forty-eight inches and a width of between twelve inches to twenty-four inches.

Straps may be attached to the corners of the panel. The straps are configured to loop around the anchor points thereby securing the panel thereto. A clip may disposed on each strap. The clip is configured to engage a loop disposed on the strap, thereby locking the strap in a looped configuration about the anchor point.

In an embodiment, the corners of the panel are tapered to reduce points of concentrated stress.

DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

Figure 1:
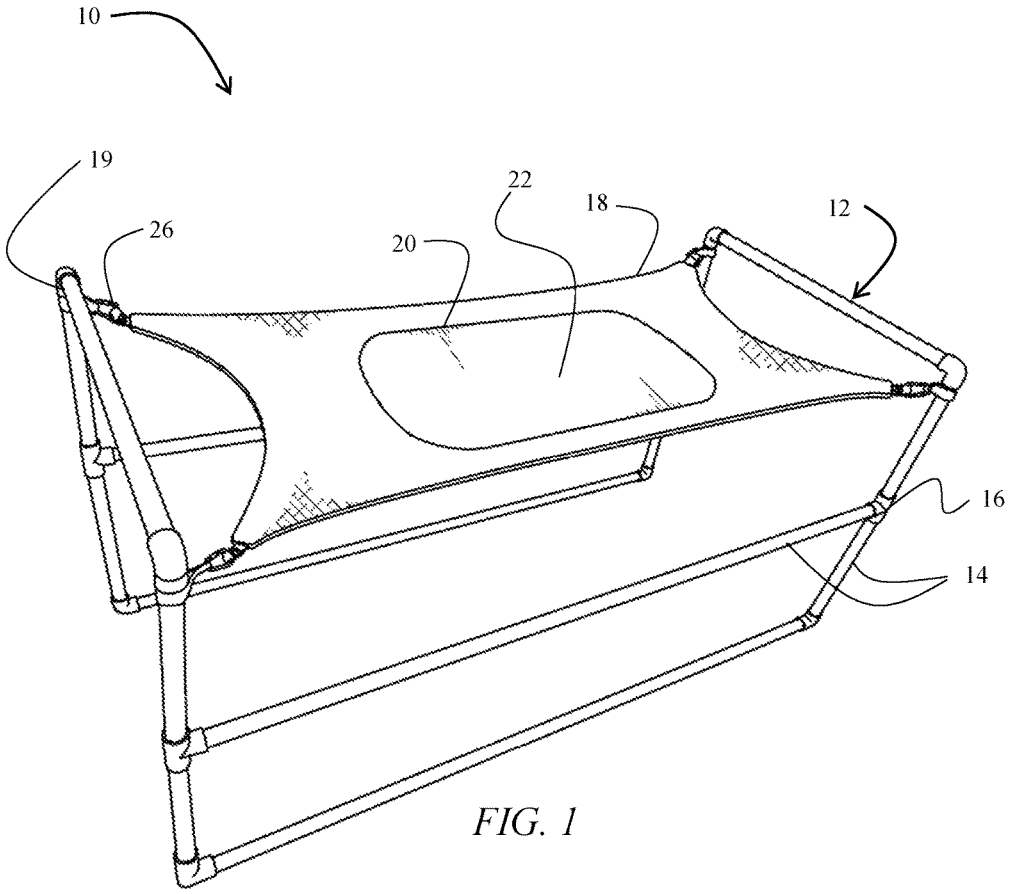
FIG. 1 is a perspective view of the infant support device.

FIG. 1 depicts an infant support device 10. Infant support device 10 has a support frame 12. Support frame 12 may comprise a plurality of interconnected support frame members 14. Support frame 12 is configured to support a load exerted onto it by a weight of an infant with a predetermined factor of safety. Support frame 12 can be made of any material having sufficient strength to withstand such loads. The materials may include plastics, wood, an array of metals and their alloys, and combinations thereof.

In an embodiment, support frame members 14 are configured to interconnect with one to form support frame 12 either by mating directly with one another or via couplings 16. In an embodiment, support frame members 14 are retained in the connected configuration by static friction between their contacting surfaces. In alternative embodiments, support frame members 14 are retained together by means of a screw threaded engagement, adhesive, fasteners, or other means known in the art.

In the embodiments in which support frame members 14 are retained in a mated configuration via friction, a screw-threaded engagement, or other non-permanent means, support frame 12 can be quickly and easily disassembled and reassembled without requiring any tools. In a disassembled configuration, support frame members 14 can be compactly packed and easily transported, thus making infant support device 10 very portable. The portability constitutes a major advancement and satisfies a significant need for an infant support device that can be readily disassembled, packed up, and transported to another location, thus providing parents with an ability to ensure that the infant has a safe and familiar bed, even when away from home.

Another advantage of support frame 12 being composed of a plurality of interconnecting support frame members 14 is that infant support device 10 can be quickly and easily adjusted to change its height or configuration. This high level of versatility allows parents to adjust the height of support device 10 to accommodate their preferences. For example, taller parents may wish to use longer support frame members 14 to increase the height of support device 10 to eliminate the need to bend over every time an infant needs to be placed into or picked up from infant support device 10. Furthermore, the configuration of support frame 12 may be adjusted to better accommodate the setting in which it is being used.

Figure 2:
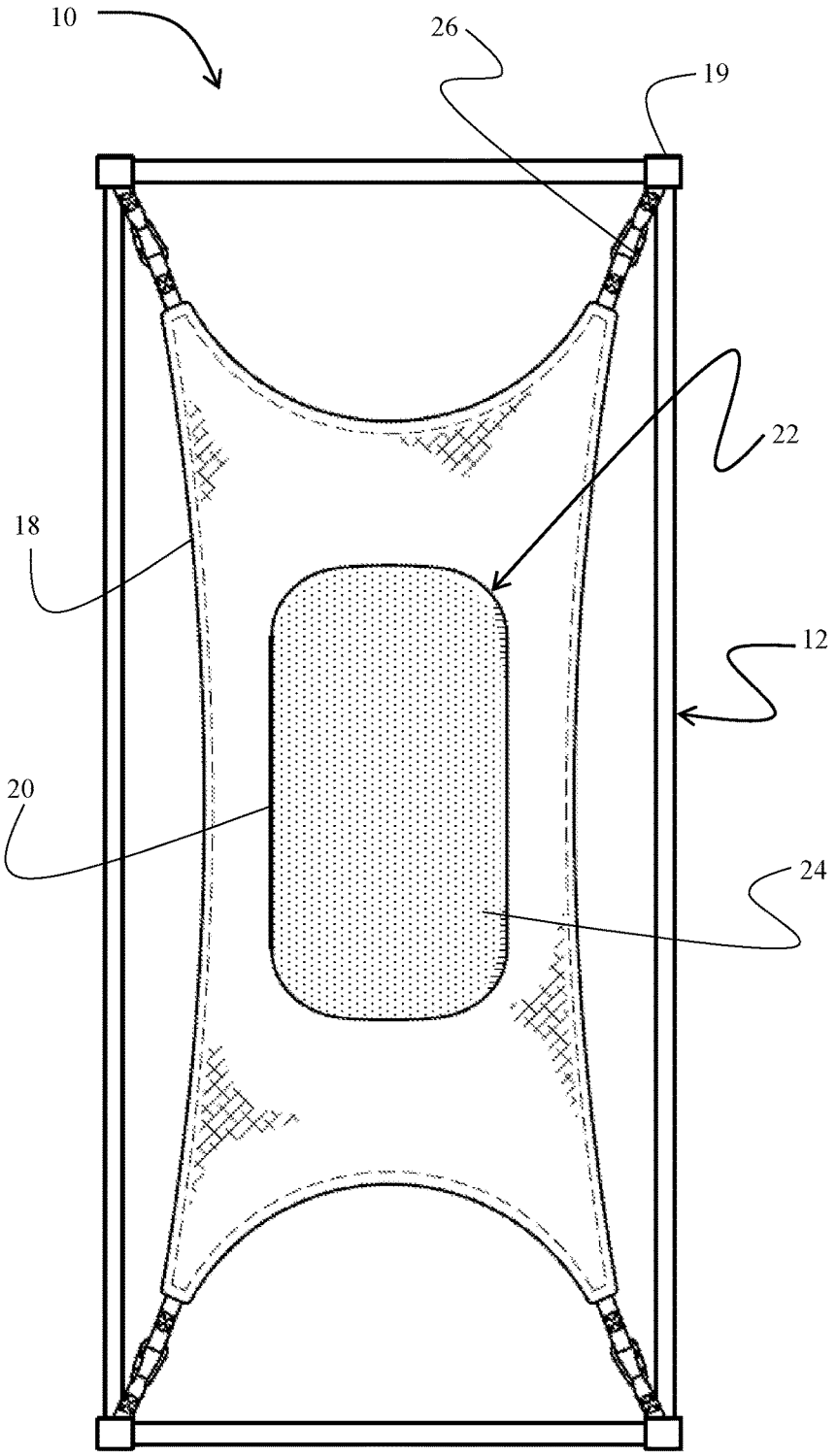
FIG. 2 is a top view of the infant support device.

As shown in FIGS. 1 and 2, infant support device 10 further includes a fabric panel 18 disposed between four anchor points 19 on support frame 12. Fabric panel 18 has an aperture 20 within which mesh insert 22 is disposed. FIG. 2 depicts that aperture 20 does not have any sharp corners thus eliminating points of concentrated stress. Nevertheless, aperture 20 is not limited to oval or rounded shapes. Mesh insert 22 is affixed to fabric panel 18 about the contour of aperture 20, thereby completely occluding aperture 20. Mesh insert 22 may be attached to fabric panel 18 via stitching, an adhesive, or any other means known in the art.

Figure 3:
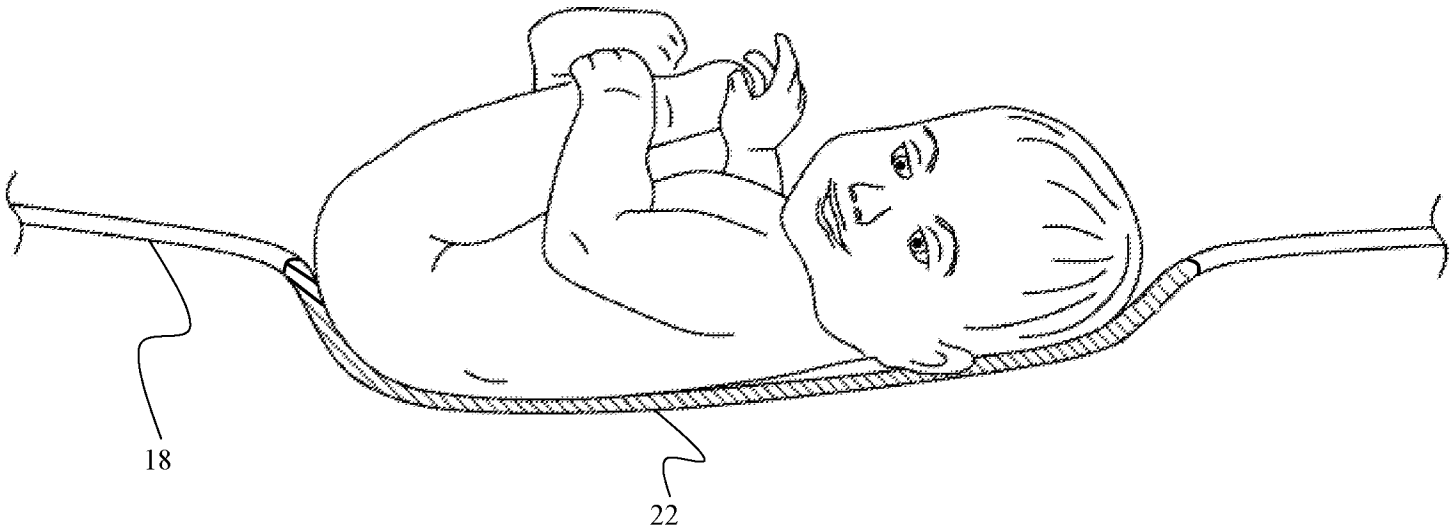
FIG. 3 is a side view of the panel and the insert disposed therein depicting the insert in a stretched configuration supporting an infant's spine in a convex curve.

As depicted in FIG. 3, the elasticity of mesh insert 22 is greater than the elasticity of fabric panel 18. When an infant is placed onto mesh insert 22, mesh insert 22 elastically deforms gently wrapping itself around the infant's body. In this deformed state, mesh insert 22 urges the infant's body into a fetal position, in which the infant's spine has a convex curve. As the Background section of this patent application explains, research has shown that maintaining a convex curve of an infant's spine promotes healthy development and provides a high level of comfort. Support provided by mesh insert 22 mimics the womb of a mother, thereby calming the infant and facilitating restful, uninterrupted sleep.

Fabric panel 18 has a higher stiffness than mesh insert 22, which enables fabric panel 18 to clearly define and maintain the edges of aperture 20 within which mesh insert 22 is disposed. The primary purpose of fabric panel 18 is to support mesh insert 22. Aperture 20, within which mesh insert 22 is disposed, is dimensioned to control the amount of deformation mesh insert 22 undergoes when an infant is placed therein. The size of aperture and low elasticity of fabric panel 18 restrict the extent to which mesh insert 22 can deform, thus controlling the maximum depth and slope of mesh insert 22. It is critical that the slope of mesh insert 22 is steep enough to permit an infant's spine to have a natural convex curve, while providing adequate support to the spine ensuring that the curvature of the spine does not exceed the optimal angle. Because the center of weight of the infant's body is positioned below the edges of aperture 20, it is virtually impossible for infant to roll outside the boundaries of mesh insert 22, thereby ensuring infant's safety against falls.

Mesh insert 22 contains a plurality of holes 24. Holes 24 are dimensioned such that oxygen can freely pass therethrough even when mesh insert 22 is in its default non-stretched configuration, in which areas of holes 24 are at their smallest. This structural feature ensures that the infant's breathing does not become constricted regardless of the position of the infant's head on mesh insert 22. Holes 24 are further dimensioned such that even when mesh insert 22 is in its outmost stretched configuration, the areas of holes 24 are insufficient for the infant's limbs and appendages to pass therethrough. This structural constraint ensures that the infant does not injure a limb or an appendage by inserting it into one of holes 24 and then twisting or overstretching it.

The following structural criteria are important for proper functionality of infant support device 10: elasticity of mesh insert 22, size of holes 24, density at which holes 24 are disposed through mesh insert 22, and dimensions of aperture 20 within which mesh insert 22 is affixed to fabric panel 18. In an exemplary embodiment, the material used for mesh insert 22 comprises 95% nylon and 5% spandex. The length of aperture 20 can range between about eighteen to about forty-eight inches, and the width can range between about twelve to about twenty-four inches. In other embodiments these dimensions may be larger or smaller to accommodate infants in various stages of their development. Holes 24 within mesh insert 22 have diameters of about 1 mm in the non-stretched configuration. It has been shown that by having the structural properties disclosed above, when an infant is placed onto mesh insert 22, mesh insert 22 elastically deforms in a way that urges the infant into a fetal position with a proper spinal curve. It has also been shown that these structural properties ensure that the infant's breathing is never constricted and limbs and appendages cannot pass through holes 24.

In the embodiment depicted in FIGS. 1-5, four straps 26 are integrated into fabric panel 18. The corners of fabric panel 18 may be tapered to reduce the points of concentrated stress, thereby reducing the likelihood for a potential tear. Thus, the tapered corners increase safety and durability of fabric panel 18. Straps 26 can be affixed to fabric panel 18 by stitching. The corners of fabric panel 18 are folded over to increase the strength of the connection between straps 26 and fabric panel 18. In alternative embodiments, straps 26 may be integrated into fabric panel 18 or attached thereto via adhesive or another means known in the art.

Figure 4:
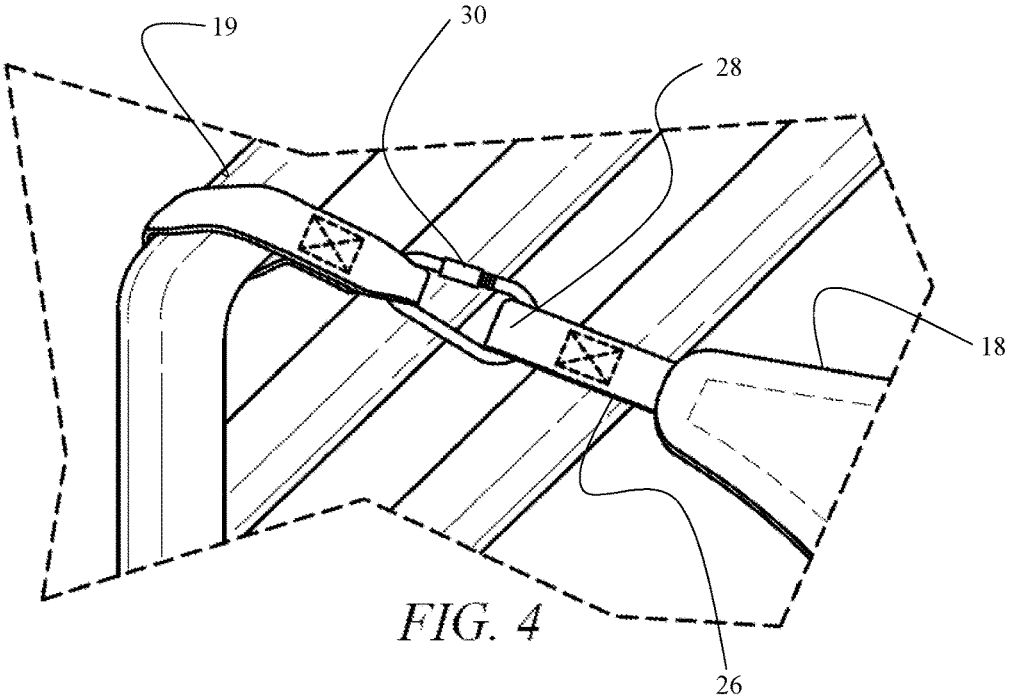
FIG. 4 is a perspective view of a strap and clip assembly used to secure the panel to an anchor point.

In the embodiment depicted in FIG. 4, strap 26 contains a plurality of loops 28 disposed thereon. A carabiner clip 30 is disposed on strap 26 and is configured to engage one of loops 28. To secure fabric panel 18 to support frame 12, a strap 26 is looped around support frame member 14, which serves as anchor point 19. Straps 26 are pulled around support frame members 14 until fabric panel 18 and mesh insert 22 disposed therein are sufficiently taut. To secure fabric panel 18 to support frame 12 once a desired tension is achieved, clip 30 is inserted into corresponding loop 28, thereby securing strap 26 to its corresponding anchor point 19. Tension of fabric panel 18 may be readily readjusted by unclipping clip 30 and inserting it into another loop 28. The anchoring configuration described herein further enhances mobility of infant support device 10 by making it extremely easy to secure and remove fabric panel 18 from support frame 12.

Figure 5:
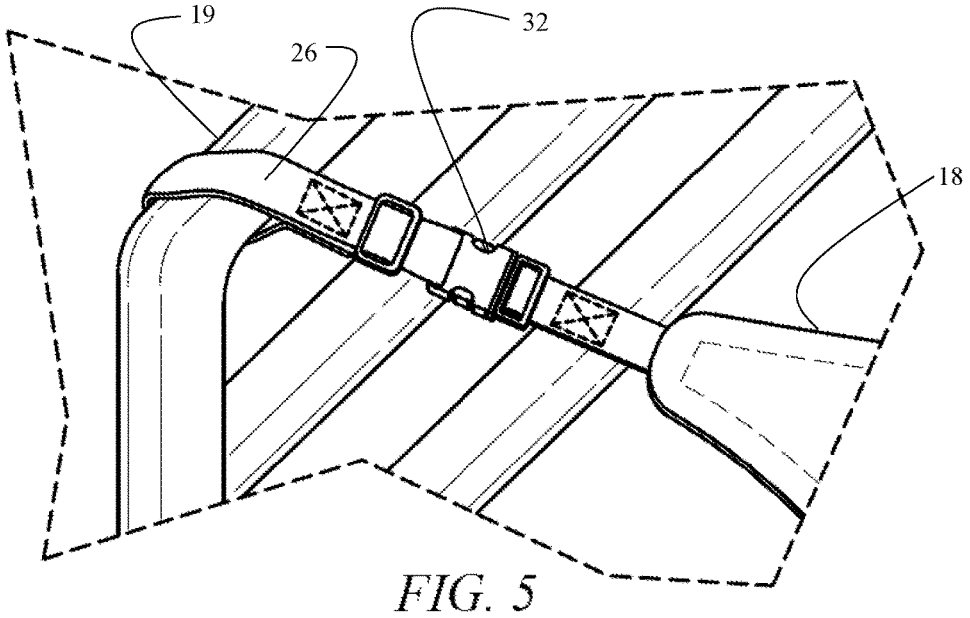
FIG. 5 is a perspective view of a strap and buckle assembly used to secure the panel to an anchor point.

In the embodiment depicted in FIG. 5, a three prong buckle 32 is used instead of clip 30 and loops 28. To secure fabric panel 18 to support frame 12, straps 26 are looped around their respective anchor support frame members 14, and buckle 32 is closed, thereby maintaining strap 26 in the looped configuration. The tension of fabric panel 18 and mesh insert 22 is adjusted by pulling on loose ends of straps 26. Other means of securing a loop in a closed configuration also fall within the scope of the invention.

Fabric panel 18 and mesh insert 22 disposed therein may be used independently of support frame 12. For example, straps 26 may be secured around a parent's neck, shoulders, or waist such that fabric panel 18 forms a sling that can be used to carry an infant. Furthermore, straps 26 may be secured to headrests of a car, a train, or an airplane seat. Tension of fabric panel 18 may be adjusted as disclosed above until mesh insert 22 is sufficiently taut to properly support an infant. Although in the embodiment described above, fabric panel 18 is secured via four straps 26 to four anchor points 19, in other embodiments the number of anchor points 19 may be reduced to two. Of course, using at least four anchor points 19 increases the safety of infant support device 10 by reducing the likelihood of fabric panel 18 flipping over about its center axis, nevertheless, in some applications—such as when fabric panel 18 is being used as a sling secured to a parent's body—a lower number of anchor points 19 may be more advantageous.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

Glossary of Terms

Anchor point—a structural component to which the panel is secured. Anchor point is configured to withstand loads exerted onto it by the taut panel and the infant placed therein.

Aperture—an opening disposed within the panel. The insert is affixed to the panel about the contour of the aperture.

Hole—an opening within the insert through which air can pass. Holes can be spaces between strands of material from which the insert is made or holes can be perforated into the insert if the spaces between the strands are insufficient or if the material does not comprise interwoven strands.

Insert—flexible material affixed to the panel occluding the aperture therein. The insert is configured to stretch responsive to an infant being placed thereon. The insert is design to stretch to an extent in which optimal spinal curve can be achieved and maintained.

Non-stretched configuration—a configuration of the insert when no infant is placed thereon.

Panel—material that is disposed between the anchor points and into which the insert is integrated. The panel has a higher stiffness than the insert thereby undergoing less elastic deformation than the insert when an infant is placed onto the insert. The panel provides structural support to a more flexible insert, which is configured to elastically deform to the extent necessary to allow an infant's spine to achieve a proper convex curve.

Stiffness—the extent to which a material resists deformation in response to an applied force. Responsive to a load being applied, materials with lower stiffness deform more than materials with higher stiffness.

Stretched configuration—a configuration of the insert when an infant is placed thereon, and the panel undergoes elastic deformation responsive to the weight of the infant being applied thereto. In the stretched configuration, the insert urges the infant's spine into a convex curve and retains the infant's spine in this configuration while the infant remains within the infant support device.

Support frame—a structure containing anchor points to which the panel is secured. In some embodiments, the support frame may be folded, collapsed, or disassembled to reduce the spatial volume it occupies.

Support frame member—a component of the support frame. Support frame members may be connected to one another forming the support frame.

What is claimed is:

1. An infant support structure comprising:

a panel configured to be deployed upon a support frame and having a first stiffness, the panel configured to be disposed in a substantially planar configuration between two or more anchor points when the panel is in a position of repose, the panel having an outer periphery and an inner contour, the inner contour defining an aperture within the panel wherein the contour of the aperture is free of corners;

the panel including a pair of opposing longitudinal sides and a pair of opposing transverse sides, wherein in a non-deployed configuration, the longitudinal sides are generally linear and the transverse sides have a first concavity toward a center of the panel and, wherein in a deployed configuration, the longitudinal sides have a second concavity toward the center of the panel less than the first concavity and the transverse sides continue to exhibit the first concavity;

an insert having a second stiffness affixed to the panel, the insert occluding the aperture within the panel, the insert having a second stiffness lower than the first stiffness of the panel, the insert having a first planar configuration and a second non-planar configuration;

a plurality of holes disposed within the insert, the holes sized to permit air to pass therethrough and to prevent an infant's limb or appendage from entering therein; and wherein responsive to an infant being placed onto the insert, the insert undergoes an elastic deformation thereby transitioning from the first planar configuration into the second non-planar configuration in which the insert urges a spine of the infant into a convex curve, the elastic deformation of the insert being greater than elastic deformation of the panel.

2. The infant support device according to claim 1, further comprising the support frame providing anchor points to which the panel is secured.

3. The infant support device according to claim 2, wherein the support frame comprises a plurality of support frame members, wherein the support frame members can be connected to one another forming the support frame or disconnected to reduce an amount of space needed for storage and transportation thereof.

4. The infant support device according to claim 1, wherein the insert comprises nylon, spandex, or both.

5. The infant support device according to claim 1, wherein the aperture has a length between eighteen inches to forty-eight inches.

6. The infant support device according to claim 1, wherein the aperture has a width between twelve inches to twenty-four inches.

7. The infant support device according to claim 1, wherein the panel is disposed between four anchor points.

8. The infant support device according to claim 1, further comprising straps attached to corners of the panel, the straps configured to loop around the anchor points thereby securing the panel thereto.

9. The infant support device according to claim 8, further comprising a clip disposed on each strap, the clip configured to engage a loop disposed on the strap thereby locking the strap in a looped configuration about the anchor point.

10. The infant support device according to claim 1, wherein comers of the panel are tapered thereby reducing points of concentrated stress.

11. The infant support device according to claim 1, wherein the holes have a width ranging from one millimeter to ten millimeters when the insert is in the stretched configuration.

12. An infant support structure comprising:

a panel configured to be deployed upon a support frame and having at least two straps attached thereto, the panel disposed in a horizontal plane between two or more anchor points on the support frame when the panel is in a position of repose, wherein the panel is secured to the support frame by the straps, the panel having a first stiffness;

the panel including a pair of opposing longitudinal sides and a pair of opposing transverse sides, wherein in a non-deployed configuration, the longitudinal sides are generally linear and the transverse sides have a first concavity toward a center of the panel and, wherein in a deployed configuration, the longitudinal sides have a second concavity toward the center of the panel less than the first concavity and the transverse sides continue to exhibit the first concavity;

an aperture disposed within the panel, the aperture having a contour, the contour defining an inner perimeter of the panel, wherein the contour of the aperture is free of corners;

an insert having a second stiffness affixed to the panel, the insert occluding the aperture, wherein the second stiffness of the insert having is lower than the first stiffness of the panel, the insert having a first planar configuration and a second non-planar configuration;

a plurality of holes disposed within the insert, the holes sized to permit air to pass therethrough and to prevent an infant's limb or appendage from entering therein;

wherein responsive to an infant being placed onto the insert, the insert undergoes an elastic deformation thereby transitioning from the first planar configuration into the second non-planar configuration in which the insert urges a spine of the infant into a convex curve, the elastic deformation of the insert being greater than elastic deformation of the panel.

13. The infant support device according to claim 12, wherein the support frame comprises a plurality of support frame members, wherein the support frame members can be connected to one another forming the support frame or disconnected to reduce an amount of space needed for storage and transportation thereof.

14. The infant support device according to claim 12, wherein the insert comprises nylon, spandex, or both.

15. The infant support device according to claim 12, wherein the aperture has a length between eighteen to forty-eight inches.

16. The infant support device according to claim 12, wherein the aperture has a width between twelve to twenty-four inches.

17. The infant support device according to claim 12, wherein the panel is disposed between four anchor points.

18. The infant support device according to claim 12, further comprising a clip disposed on each strap, the clip configured to engage a loop disposed on the strap thereby locking the strap in a looped configuration about the anchor point.

19. The infant support device according to claim 12, wherein corners of the panel are tapered thereby reducing points of concentrated stress.

20. The infant support device according to claim 12, wherein the holes have a width ranging from one millimeter to ten millimeters when the insert is in the stretched configuration.

* * * * *